US010263369B2

(12) United States Patent
Zhao et al.

(10) Patent No.: US 10,263,369 B2
(45) Date of Patent: Apr. 16, 2019

(54) ELECTRICAL CONNECTOR EQUIPPED WITH DISCRETE BOTTOM PLATE FOR MOUNTING TO PCB

(71) Applicant: FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/817,311

(22) Filed: Nov. 20, 2017

(65) Prior Publication Data

US 2018/0145461 A1 May 24, 2018

(30) Foreign Application Priority Data

Nov. 18, 2016 (CN) ..... 2016 2 1254897 U

(51) Int. Cl.

| | |
|---|---|
| ***H01R 12/57*** | (2011.01) |
| ***H01R 12/72*** | (2011.01) |
| ***H01R 24/60*** | (2011.01) |
| ***H01R 13/405*** | (2006.01) |
| ***H01R 13/506*** | (2006.01) |
| ***H01R 13/6585*** | (2011.01) |

(Continued)

(52) U.S. Cl.

CPC ..... *H01R 13/6594* (2013.01); *H01R 13/405* (2013.01); *H01R 13/506* (2013.01); *H01R 13/6585* (2013.01); *H01R 13/6595* (2013.01); *H01R 12/57* (2013.01); *H01R 12/724* (2013.01); *H01R 24/60* (2013.01)

(58) Field of Classification Search

CPC ..... H01R 13/6585; H01R 13/6581; H01R 13/65802; H01R 13/6594; H01R 13/405; H01R 13/506; H01R 13/6595; H01R 23/6873; H01R 23/7073; H01R 12/724; H01R 12/57; H01R 24/60

USPC ..... 439/607.35, 607.36, 607.37, 607.4

See application file for complete search history.

(56) References Cited

U.S. PATENT DOCUMENTS 7,837,506 B1 * 11/2010 Chiang ..... H01R 12/707 439/607.27

8,282,417 B2 * 10/2012 Xiao ..... H01R 13/648 439/607.36

(Continued)

FOREIGN PATENT DOCUMENTS

CN 204632967 U 9/2015

CN 105375157 A 3/2016

(Continued)

*Primary Examiner* — Gary F Paumen

(74) *Attorney, Agent, or Firm* — Wei Te Chung; Ming Chieh Chang

(57) ABSTRACT

An electrical connector including a contact module having an insulative housing with a plurality of contacts disposed therein and enclosed within a first metallic shell, and a second metallic shell attached to the first shell and located between the first shell and the printed circuit board so as to allow the raised type mating cavity which is formed by the first shell. The contact module includes a metallic shielding plate with an oblique section. A pair of Z-shaped fixing columns are located by two sides of the oblique section.

6 Claims, 14 Drawing Sheets

(51) Int. Cl.
*H01R 13/6594* (2011.01)
*H01R 13/6595* (2011.01)

(56) References Cited

U.S. PATENT DOCUMENTS

| | | | | |
|---|---|---|---|---|
| 8,827,742 | B2 * | 9/2014 | Wang | H01R 24/68 439/569 |
| 8,920,197 | B2 * | 12/2014 | Tziviskos | H01R 13/405 439/660 |
| 8,974,249 | B2 * | 3/2015 | Zhang | H01R 12/724 439/607.4 |
| 9,490,595 | B2 * | 11/2016 | Little | H01R 13/6594 |
| 2001/0053630 | A1 * | 12/2001 | Shi | H01R 13/6582 439/607.55 |
| 2007/0105440 | A1 * | 5/2007 | Delaney | H01R 12/714 439/607.36 |
| 2013/0203290 | A1 * | 8/2013 | Zhang | H01R 12/724 439/607.36 |
| 2013/0231004 | A1 * | 9/2013 | Yang | H01R 12/57 439/607.36 |
| 2015/0194768 | A1 * | 7/2015 | Little | H01R 13/6594 439/607.37 |
| 2016/0072208 | A1 * | 3/2016 | Li | H01R 13/6594 439/78 |

FOREIGN PATENT DOCUMENTS

| | | | |
|---|---|---|---|
| CN | 105406256 | A | 3/2016 |
| CN | 105576416 | A | 5/2016 |
| CN | 105703144 | A | 6/2016 |
| CN | 205376880 | U | 7/2016 |
| CN | 105914520 | A | 8/2016 |
| CN | 205429282 | U | 8/2016 |
| CN | 205595547 | U | 9/2016 |

* cited by examiner

ELECTRICAL CONNECTOR EQUIPPED WITH DISCRETE BOTTOM PLATE FOR MOUNTING TO PCB

BACKGROUND OF THE DISCLOSURE

1. Field of the Disclosure

The invention is related to an electrical connector and particularly to the electrical connector adapted to be mounted to a printed circuit board and compliant with the device casing. The instant application relates to the copending application with a Ser. No. 15/817,321, having the same inventors and the same applicant and titled "ELECTRICAL CONNECTOR EQUIPPED WITH AN OBLIQUE STRUCTURE FOR PROVIDING RECEIVING SPACE".

2. Description of Related Arts

Chinese Patent Application Publication No. 105375157A and CN105322386A both disclose the so-called sink type connector which is located in a notch of the printed circuit board for a low profile arrangement, thus unfitting the device casing having the upper or standard level insertion opening for the electrical connector.

It is desired to provide an electrical connector which is essentially mounted upon the printed circuit board with proper support around the shell, and has the corresponding upper insulator and lower insulator both essentially extending in an oblique manner around for compliance with the obliquely extending retaining sections of the contacts.

SUMMARY OF THE DISCLOSURE

To achieve the above desire, an electrical connector adapted for mounting to an upper surface of the printed circuit board, including a contact module having an insulative housing with a plurality of contacts disposed therein and enclosed within a first metallic shell, and a second metallic shell attached to the first shell and located between the first shell and the printed circuit board so as to allow the raised type mating cavity which is formed by the first shell. The contact module includes a metallic shielding plate with an oblique section. A pair of Z-shaped fixing columns are located by two sides of the oblique section.

DETAILED DESCRIPTION OF THE PREFERRED EMBODIMENT

Figure 1:
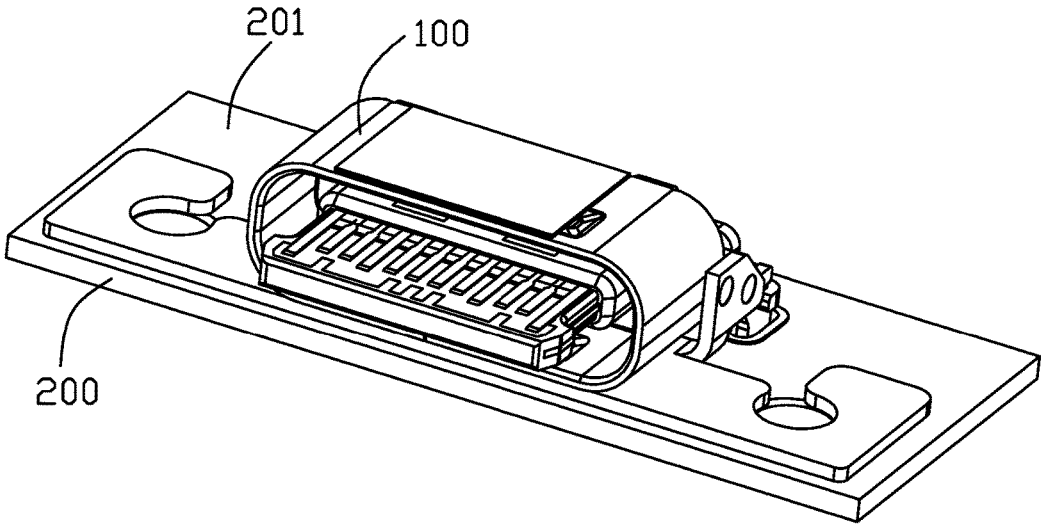
FIG. 1 is a front downward perspective view of an electrical connector mounted upon a printed circuit board according to the invention.
Figure 2:
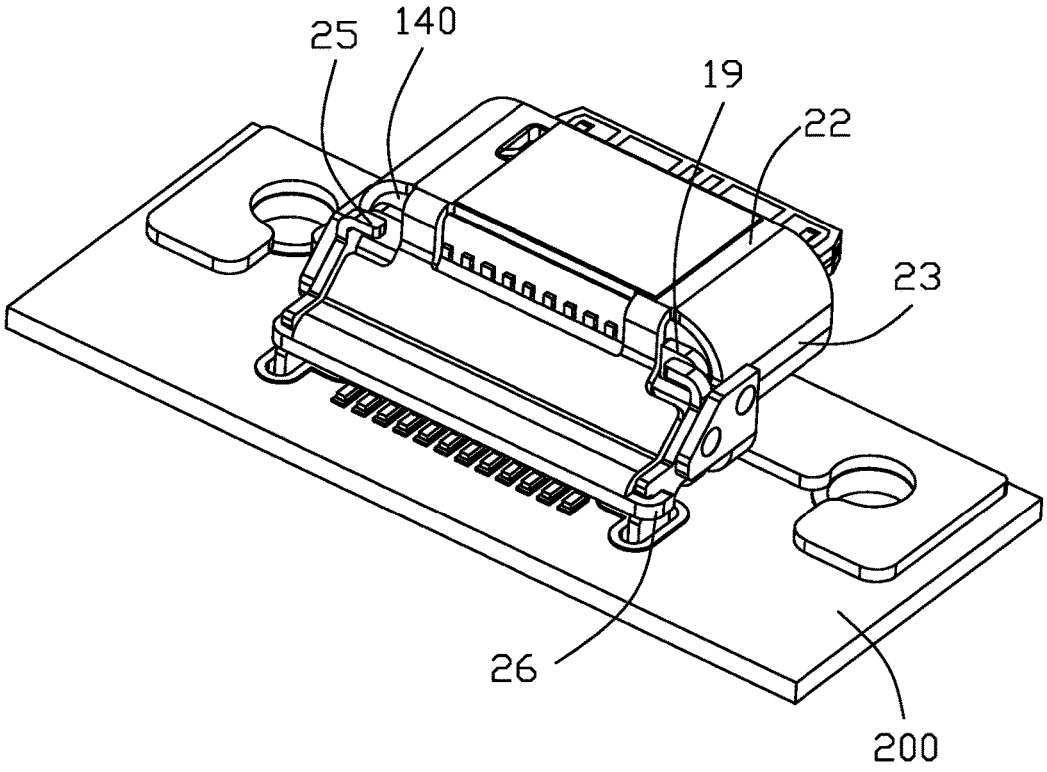
FIG. 2 is a rear downward perspective view of the electrical connector mounted upon the printed circuit board of FIG. 1.
Figure 3:
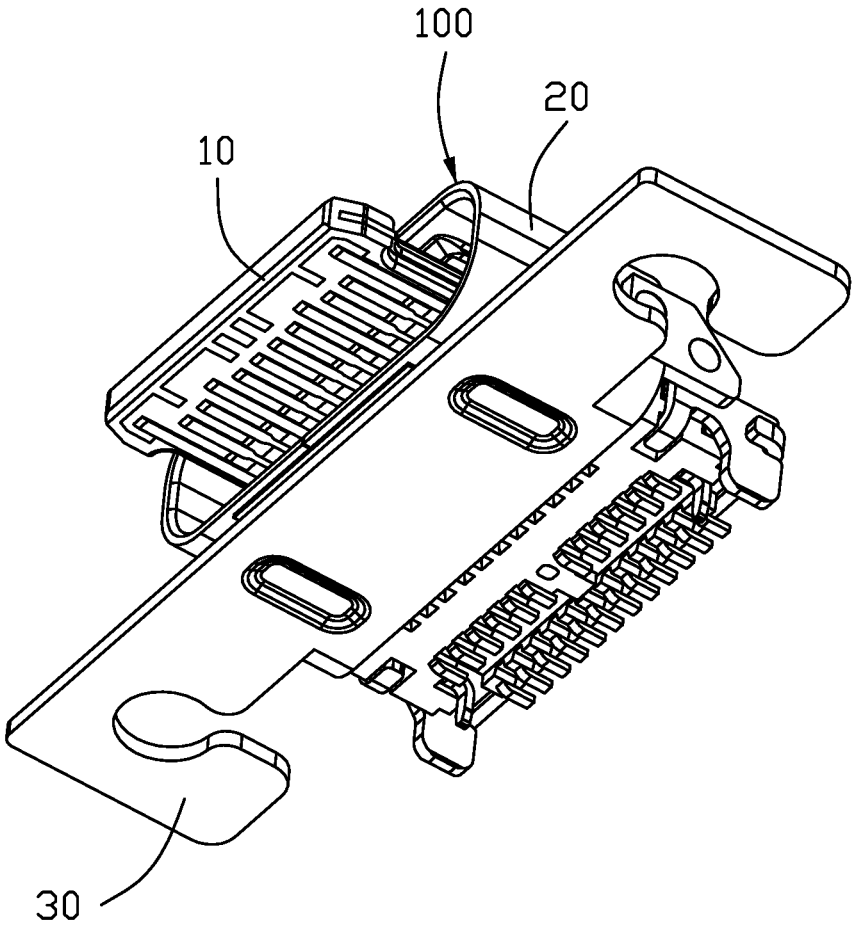
FIG. 3 is a front upward perspective view of the electrical connector of FIG. 1.
Figure 4:
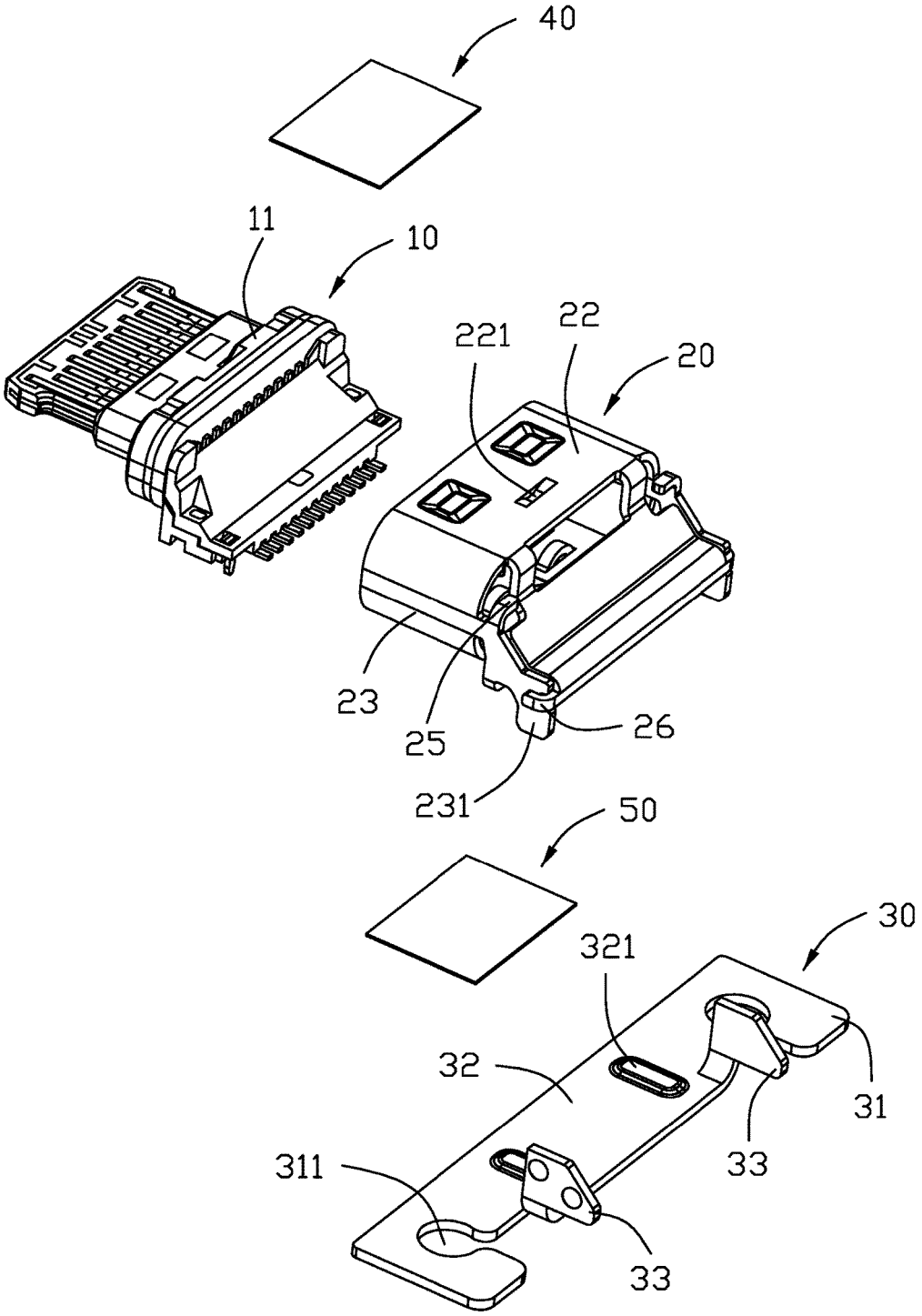
FIG. 4 is a rear downward exploded perspective view of the electrical connector of FIG. 3.
Figure 5:
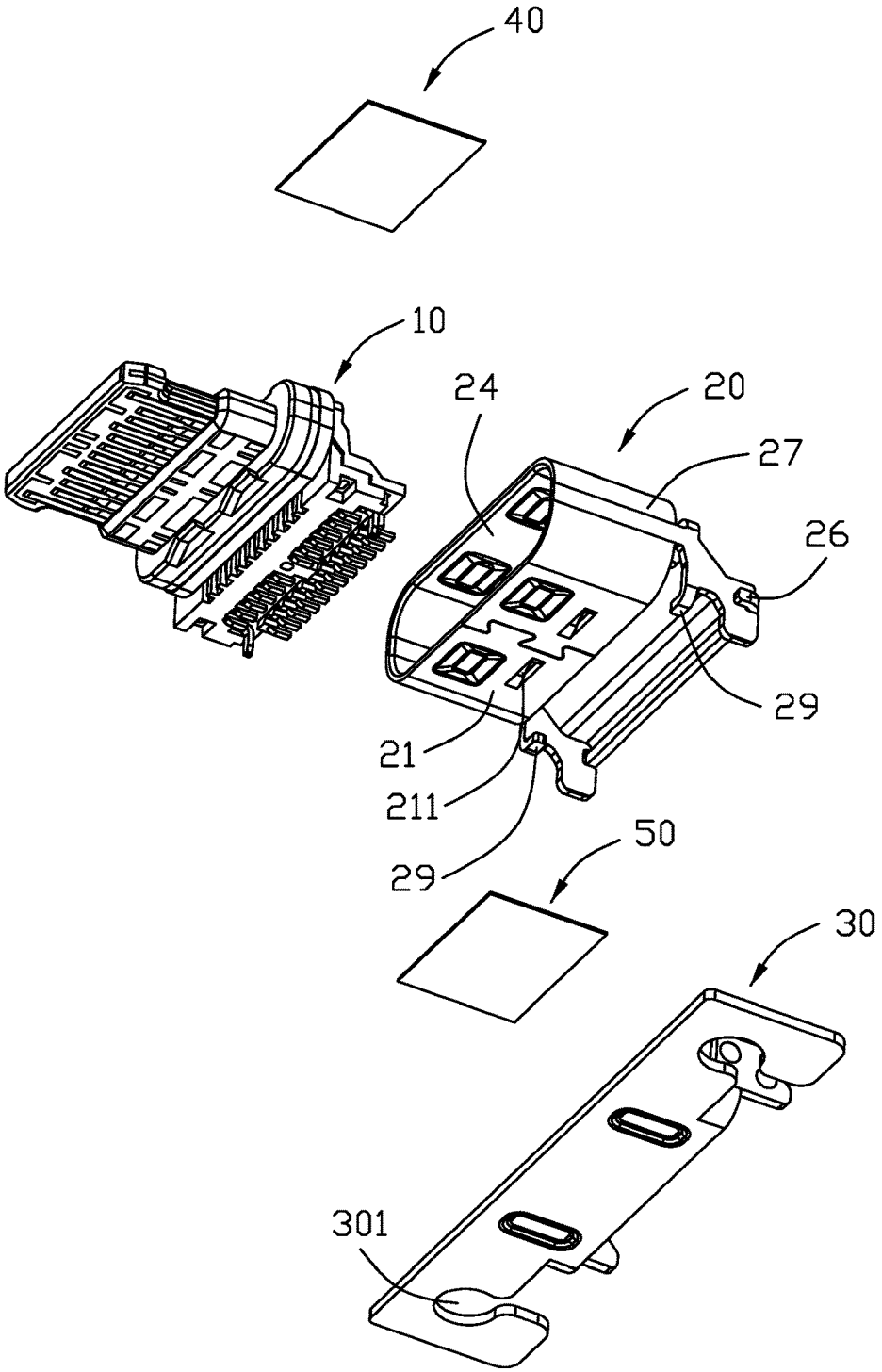
FIG. 5 is a front upward exploded perspective view of the electrical connector of FIG. 4.
Figure 6:
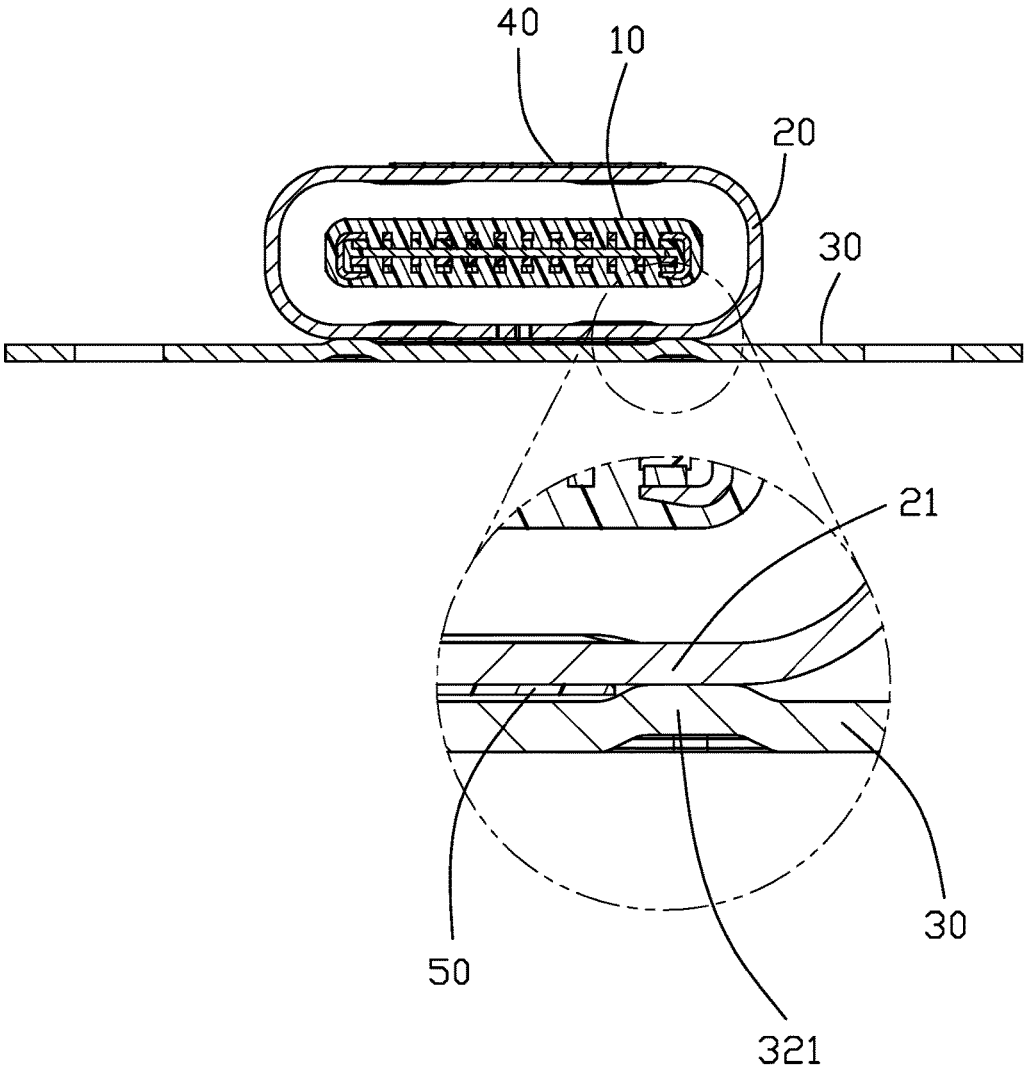
FIG. 6 is a cross-sectional view of the electrical connector of FIG. 3.
Figure 7:
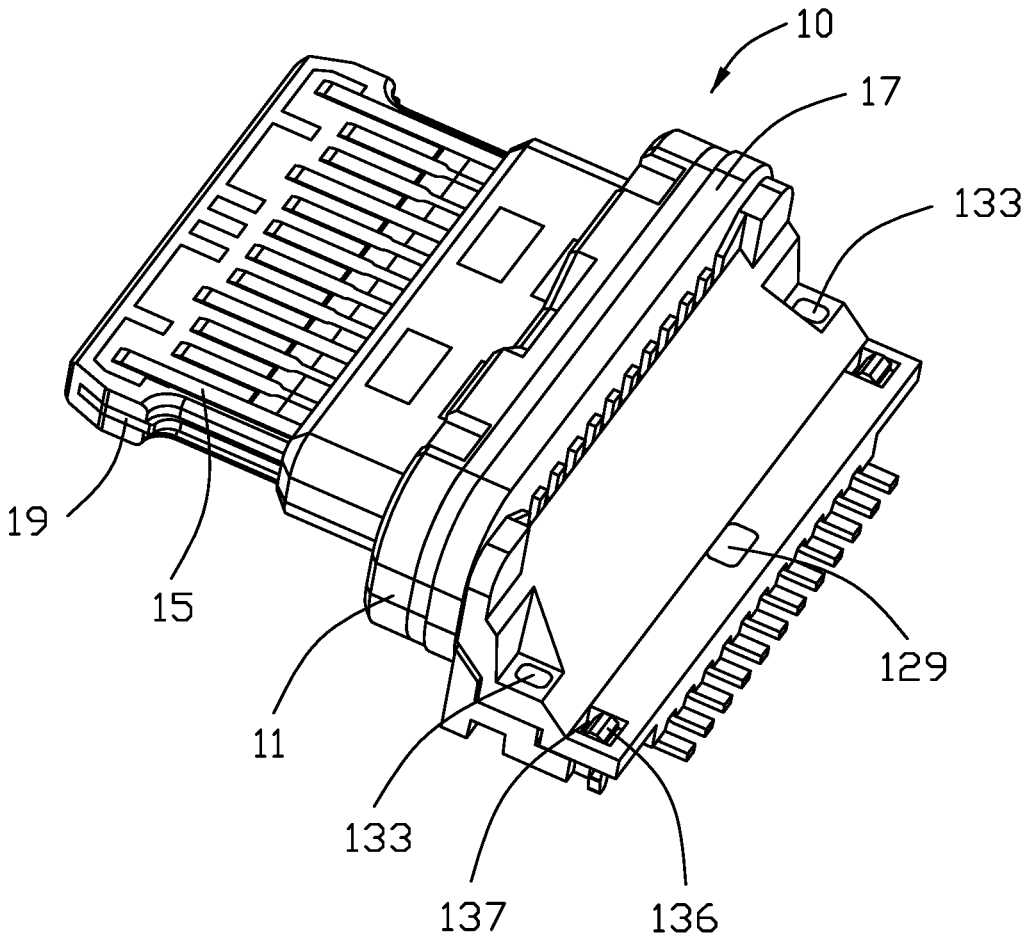
FIG. 7 is a rear downward perspective view of the contact module of the electrical connector of FIG. 4.
Figure 8:
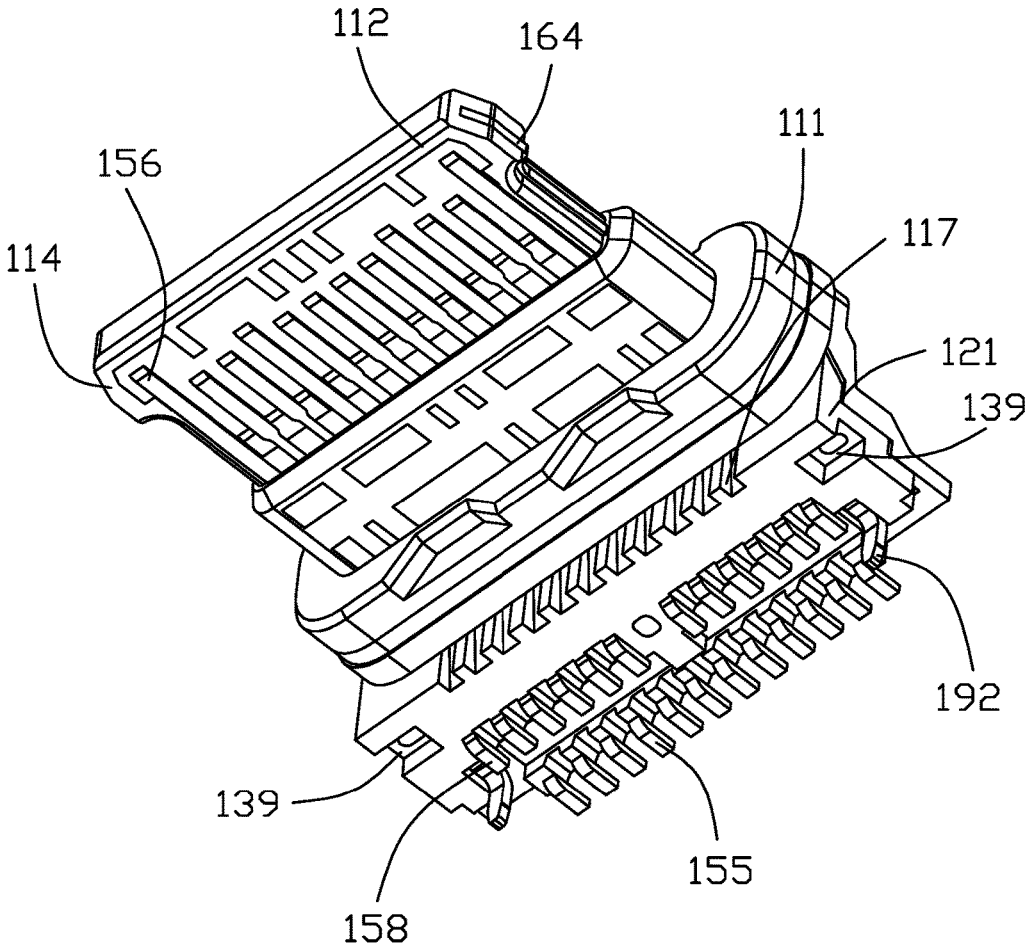
FIG. 8 is a front upward perspective view of the contact module of the electrical connector of FIG. 7.
Figure 9:
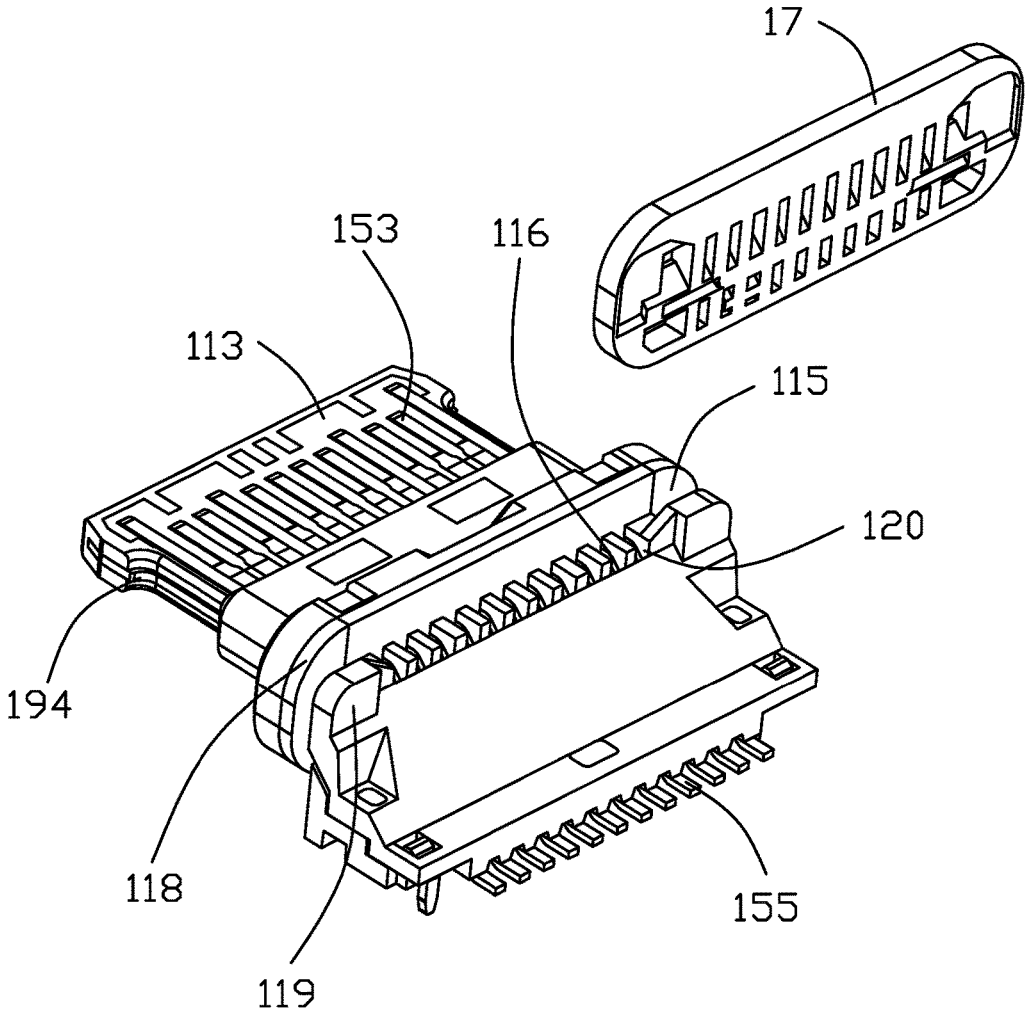
FIG. 9 is a rear downward exploded perspective view of the contact module of the electrical connector of FIG. 7.
Figure 10:
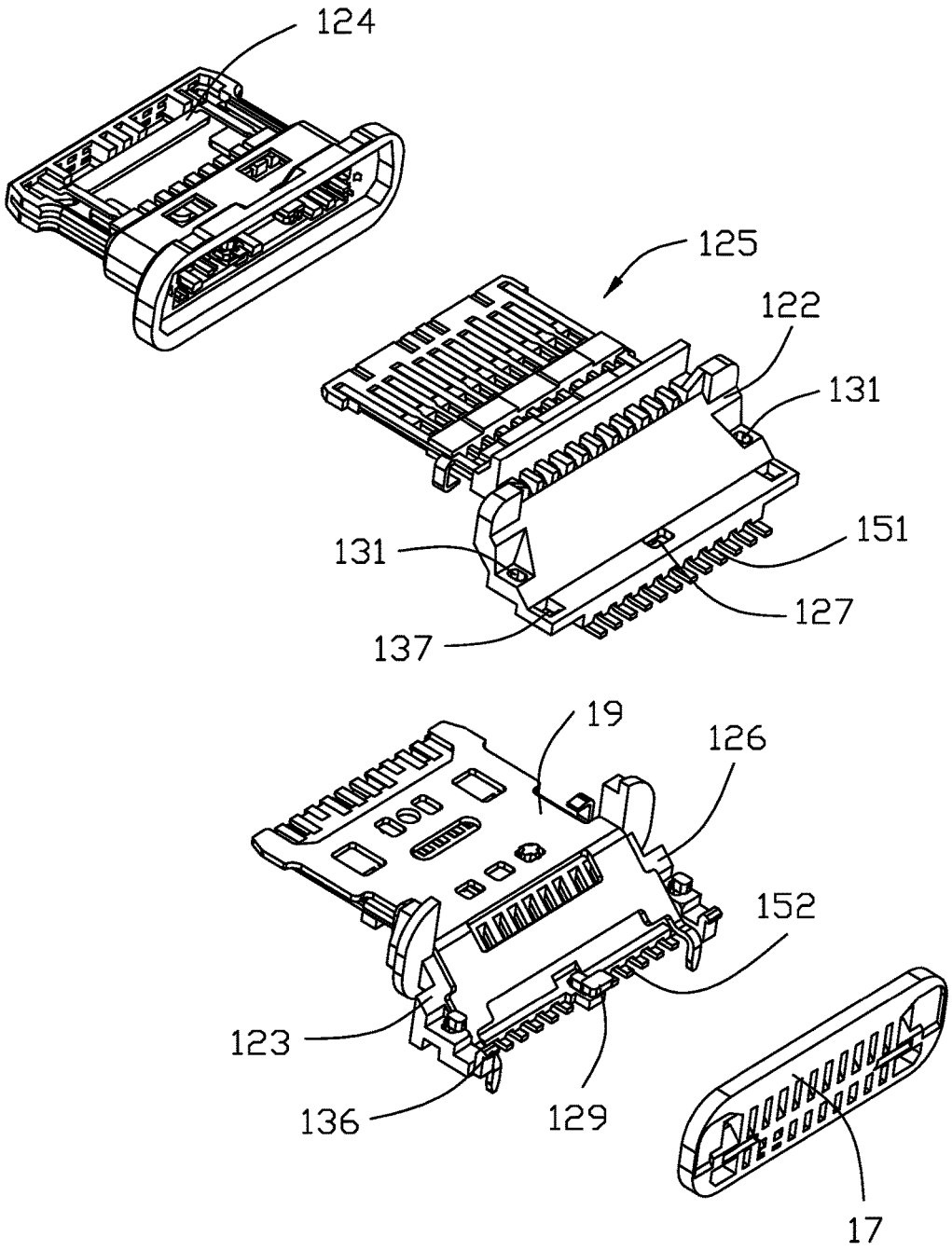
FIG. 10 is a further rear downward exploded perspective view of the contact module of the electrical connector of FIG. 9.
Figure 11:
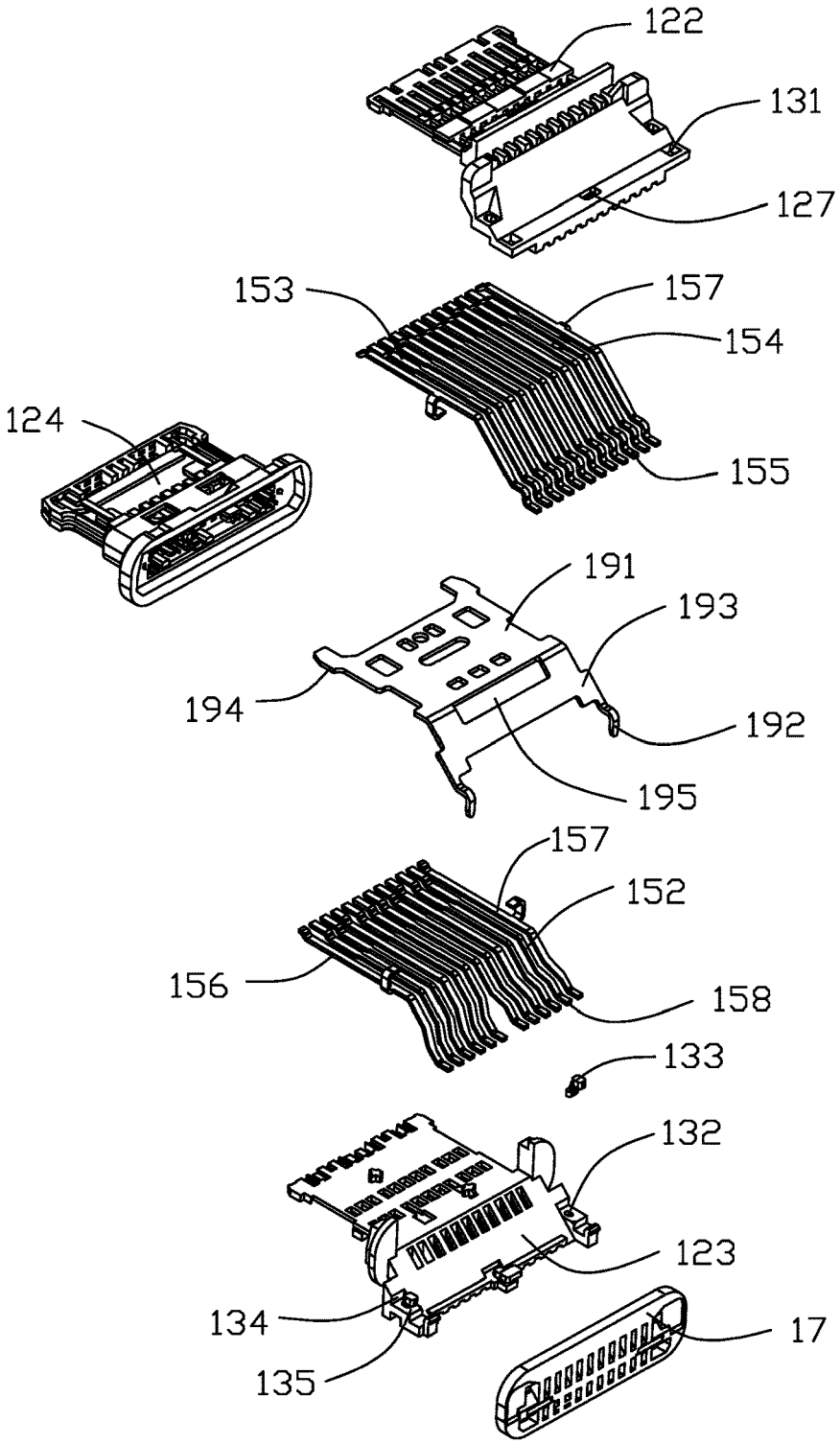
FIG. 11 is a further rear downward exploded perspective view of the contact module of the electrical connector of FIG. 10.
Figure 12:
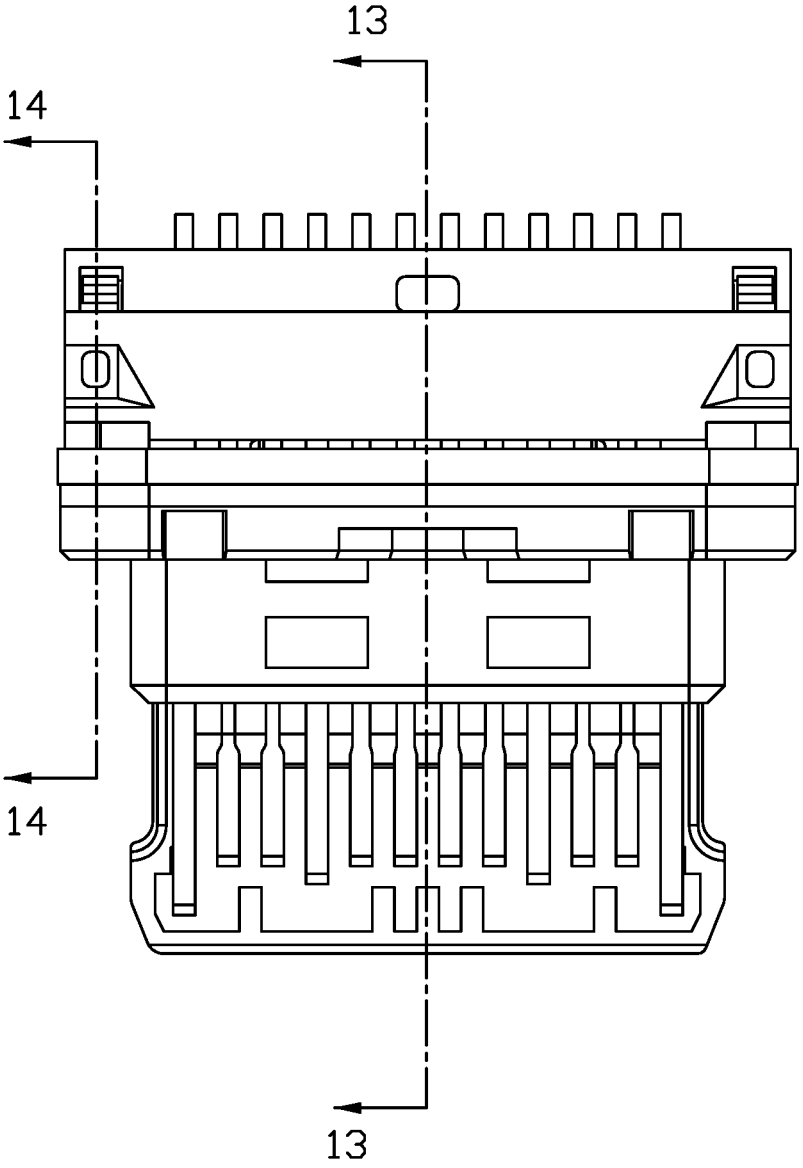
FIG. 12 is a bottom view of the contact module of the electrical connector of FIG. 7

Reference will now be made in detail to the embodiments of the present disclosure. Referring to FIGS. 1-14, an electrical card connector 100 is used to be mounted to an upper surface 201 of a printed circuit board 200. The electrical connector 10 includes a contact module 10, a first metallic shell 20, a second metallic shell 30, a first insulating film 40 and a second insulating film 50.

The contact module 10 includes an insulative housing 11, a plurality of contacts 15 disposed in the insulative housing 11, the waterproof plate 17 enclosing the contacts 15, and a metallic shielding plate 19 embedded within the insulative housing 11. The insulative housing 11 includes a base 111 and a tongue portion 112 extending forwardly from the base 111 and forming opposite upper surface 113 and lower surfaces 114. The base 111 forms a groove 115 and the holes 116 communicating with the groove 115. The waterproof plate 17 fills both the groove 115 and the holes 116. The base further forms escaping holes 117 communicating with the holes 116. The base 111 includes a front region 118, the rear region 119 and a middle region 120 between the front region 118 and the rear region 119 in a front-to-back direction. The holes 116 are formed in the middle region 120. The groove 115 is formed between the front region 118 and the rear region 119. The escaping holes 117 are formed in the rear region 119 which forms a bottom portion 121, and the escaping holes 117 extend through the bottom portion 121 forwardly and downwardly. The escaping holes 117 may assure flowing the glue for forming the waterproof plate 17.

The contacts 15 includes the upper contact 151 and the lower contacts 151. The upper contact 151 includes a front upper contacting section 153 exposed upon the upper surface 113 of the tongue portion 112, the middle upper retaining section 154 embedded within the housing 11, and a rear upper soldering section 155 extending out of the housing 11. The lower contact 152 includes a front lower contacting section 156 exposed upon the lower surface 114 of the tongue portion 11, a middle lower retaining section 157 embedded within the housing 11, and a rear lower soldering section 158 extending out of the housing 11. Notably, in this embodiment, an oblique section (not labeled) is formed between the upper retaining section 154 and the upper soldering section 155, and similarly an oblique section (not labeled) is formed between the lower retaining section 157 and the lower soldering section 158 for complying with the oblique portions of the upper insulator 122 and the lower insulator 123.

The housing 11 includes an upper insulator 122, the lower insulator 123 and the covering insulator 124. The upper contacts 151 and the upper insulator 122 commonly form the upper contact module 125, and the lower contacts 142 and the lower insulator 123 commonly form the lower contact module 126. The upper contact module 125, the lower contact module 126 are assembled to commonly sandwich the shielding plate 19 therebetween as a sub-assembly and the covering insulator 124 are applied upon the sub-assembly.

The shielding plate 19 includes a horizontal section 191, a pair of soldering legs 192 extending our of the housing 11 for mounting to the printed circuit board 200, and an oblique section 132 between the horizontal section 191 and the pair of soldering legs 192. The oblique section 193 extends rearwardly and downwardly to have the tongue portion 112 raised upwardly correspondingly. The horizontal section 191 forms a pair of latching sections 194 on two lateral sides for locking with the corresponding plug connector. The shielding plate 19 forms an opening 195 corresponding to the holes 116 so as to assure flowing of the glue for forming the waterproof plate 17.

The upper insulator 122 has a first middle fixing hole 129 at the middle region in the transverse direction, the lower insulator 123 has the second middle fixing hole 128 corresponding to the first fixing hole 129. The insulative housing 11 further includes a first fixing column 129 extending through both the first middle fixing hole and the second middle fixing hole. The upper insulator 122 has the first side fixing hole 131, and the lower insulator 123 has the second side fixing hole 132. The insulative housing 11 further includes a second fixing column 133 extending through both the corresponding first side fixing hole 131 and second side fixing hole 132. Notably, the first fixing column 129 and the second fixing column 133 are formed via the same insert-molding or over-molding process during forming the covering insulator 124. Notably, the upper insulator 122 and the lower insulator 123 form the oblique surface 134 and the platform 135 around the second fixing column 133 for easy forming the second fixing column 133.

The lower insulator 123 forms the positioning post 136, and the upper insulator 122 forms the positioning hole 137 in which the positioning post 136 is received. Notably, both the first fixing column 129 and the second fixing column 133 are of a Z-shaped configuration for assuring the upper soldering sections 155 of the upper contacts 151 and the lower soldering sections 158 of the lower contacts 152 are coplanar with each other. In this embodiment, the upper insulator 122 and the lower insulator 123 form the corresponding oblique portions (not labeled) to commonly sandwich the oblique section 193 of the shielding plate 19 therebetween compliantly.

The first shell 20 enclosing the housing 11 and includes a bottom face 21 close to the printed circuit board 200, a top face 22 opposite to the bottom face 21, the side faces 23 connecting the bottom face 21 and the top face 22. All the bottom face 21, the top face 22 and the side faces 23 commonly form the mating cavity 24. The top face 22 forms a downward recess 221, and the bottom face 21 forms a pair of upward recesses 211. The first insulating film 40 is attached upon the top face 22 to cover the downward recess 221, and the second insulating film 50 is attached upon the bottom face 21 to cover the upward recesses 211.

The second shell 30 is attached to the first shell 20 and includes a pair of mounting legs 31 and a plate 32 attached upon the bottom face 21 wherein the plate 32 and the mounting legs 31 are coplanar with each other. The second shell 30 further includes a pair of wings 33 extending upwardly to be soldered to the side faces 23, respectively The mounting leg 31 includes a screw hole 311 for mounting to the printed circuit board 200. In this embodiment, the screw hole 311 is open sidewardly for easy forming by stamping. The plate 32 is located under the bottom face 21 so as to raise upon the mating cavity 24 for complying with the opening of the device casing. A pair of ribs 321 are formed upon the plate 32 by two sides of the second insulating film 50 with a thickness of more than 0.1 mm to be larger than that of the second insulating film 50 which is generally 0.06 mm so as to assure reliable soldering between the ribs 321 and the bottom face 21 without hindrance of the second insulating film 50.

Figure 13:
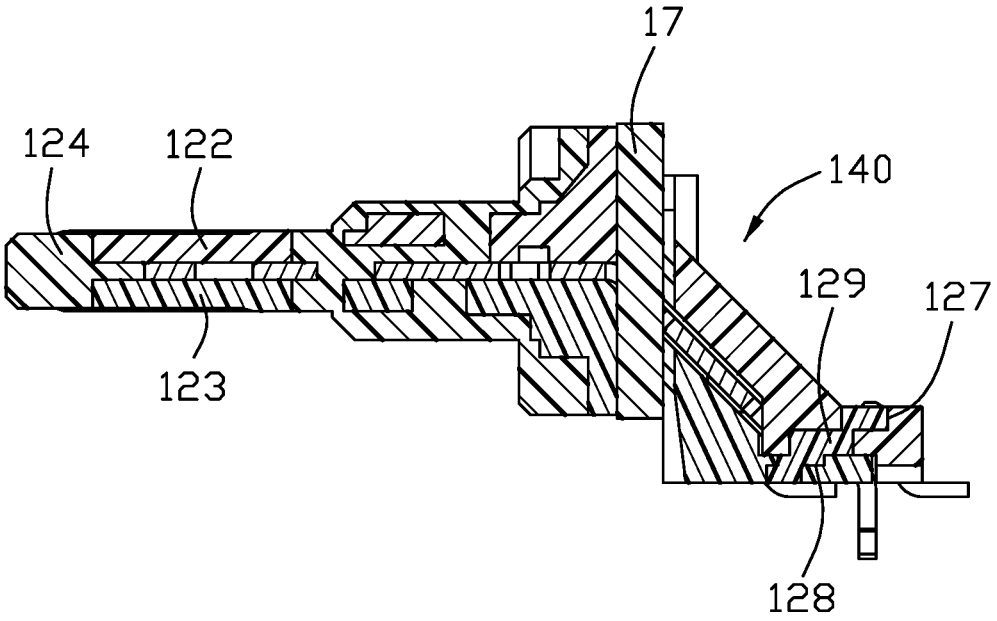
FIG. 13 is a cross-sectional view of the contact module of the electrical connector of FIG. 12.
Figure 14:
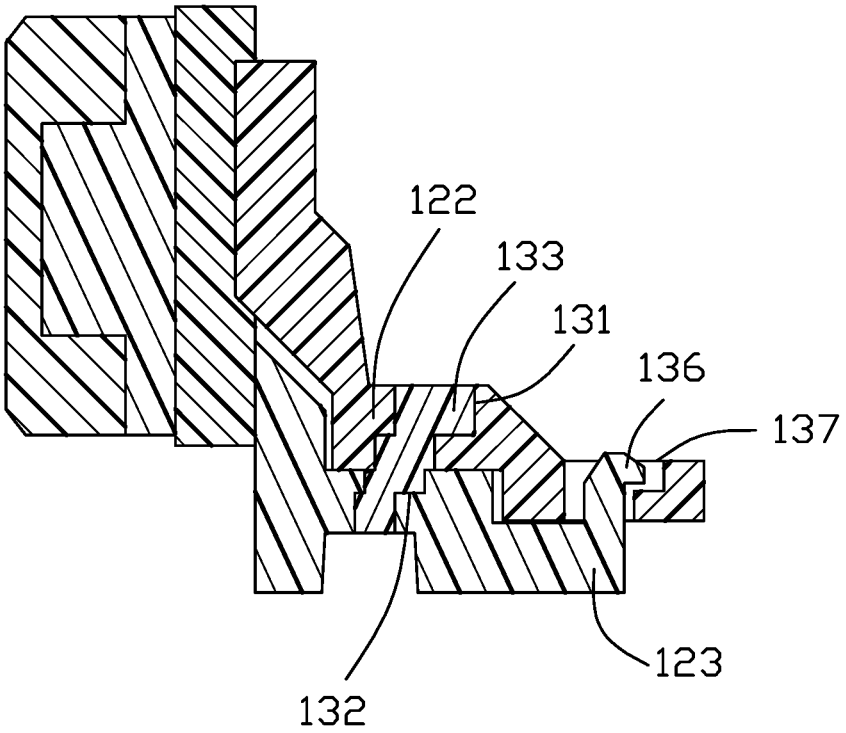
FIG. 14 is another cross-sectional view of the contact module of the electrical connector of FIG. 12.

The rear region 119 of the base 111 has a top face lower than the top face 22 of the shell 20 so as to form a receiving space 140 for receiving the electronic parts. The first shell 20 further includes a pair of bending pieces 25 extending from the side faces 23 for preventing backward movement of the contact module 10 during mating, and a pair of securing pieces 26 for restraining outward deflection of the side extensions 231. A pair of securing tabs 29 opposite to the corresponding bending pieces 25 in the vertical direction for being received within corresponding recesses 139 in an undersurface of the bottom portion 121 to upwardly cover the corresponding second fixing column 133. The first shell 20 includes an oblique section (not labeled) compliantly covering the corresponding oblique portion of the upper insulator 122 so as to leave a relatively large receiving space 140 above as mentioned before. Notably, as shown in FIG. 13, the receiving space 140 is essentially aligned with the mating cavity 24 in the front-to-back direction.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a contact module including:

an insulative housing having a base and a tongue portion extending forwardly from the base in a front-to-back direction;

a plurality of contacts disposed in the housing;

a first metallic shell enclosing the contact module, said first metallic shell including opposite bottom and top faces and opposite side faces commonly forming a mating cavity in which the tongue portion extends; and a second metallic shell attached to an underside of the bottom face; wherein said second metallic shell forms a pair of mounting legs on two opposite sides of a middle plate in a transverse direction perpendicular to the front-to-back direction, and each of said mounting legs includes a hole extending therethrough in a vertical direction perpendicular to both said front-to-back direction and the transverse direction; wherein each of said mounting legs lies in a horizontal plane and extends outwardly from the middle plate in the transverse direction; wherein the pair of mounting legs are coplanar with the middle plate so as to be adapted to be commonly seated upon a printed circuit board;

wherein the contact module includes an upper contact module and a lower contact module commonly sandwiching a metallic shielding plate therebetween in the vertical direction;

wherein the shielding plate includes a horizontal section embedded within the tongue portion, a pair of soldering legs exposed outside of the housing, and an oblique section between the horizontal section and the pair of soldering legs;

wherein the housing includes both an upper insulator of the upper contact module and a lower insulator of the lower contact module forming corresponding oblique portions to sandwich the oblique section of the shielding plate therebetween compliantly.

2. The electrical connector as claimed in claim 1, wherein said contacts include both a plurality of upper contacts in the upper insulator and a plurality of lower contacts in the lower contact module, said upper contacts and said lower contacts form corresponding oblique sections for complying with the oblique portions of the corresponding upper insulator and lower insulator.

3. The electrical connector as claimed in claim 1, wherein the first metallic shell forms an oblique section compliantly covering the oblique portion of the upper insulator and leave a receiving space above.

4. The electrical connector as claimed in claim 3, wherein said receiving space is aligned with the mating cavity in the front-to-back direction.

5. An electrical connector comprising:

a contact module including:

an insulative housing having a base and a tongue portion extending forwardly from the base in a front-to-back direction;

a plurality of contacts disposed in the housing;

a first metallic shell enclosing the contact module, said first metallic shell including opposite bottom and top faces and opposite side faces commonly forming a mating cavity in which the tongue portion extends; and a second metallic shell attached to an underside of the bottom face; wherein said second metallic shell forms a pair of mounting legs on two opposite sides of a middle plate in a transverse direction perpendicular to the front-to-back direction, and each of said mounting legs includes a hole extending therethrough in a vertical direction perpendicular to both said front-to-back direction and the transverse direction; wherein each of said mounting legs lies in a horizontal plane and extends outwardly from the middle plate in the transverse direction; wherein the pair of mounting legs are coplanar with the middle plate so as to be adapted to be commonly seated upon a printed circuit board;

wherein the contact module includes an upper contact module and a lower contact module commonly sandwiching a metallic shielding plate therebetween in the vertical direction;

wherein the shielding plate includes a horizontal section embedded within the tongue portion, a pair of soldering legs exposed outside of the housing, and an oblique section between the horizontal section and the pair of soldering legs;

wherein a pair of Z-shaped side fixing columns are located by two opposite lateral sides of the oblique section of the shielding plate in the transverse direction to secure the upper contact module and the lower contact module together in the vertical direction.

6. An electrical connector comprising:

a contact module including:

an insulative housing having a base and a tongue portion extending forwardly from the base in a front-to-back direction;

a plurality of contacts disposed in the housing; and a first metallic shell enclosing the contact module, said first metallic shell including opposite bottom and top faces and opposite side faces commonly forming a mating cavity in which the tongue portion extends; wherein each side face further includes a rearward extension defining a bending piece lying in a horizontal plane and abutting against the housing for preventing rearward movement of the housing relative to the shell, and a securing tab lying in another horizontal plane and located opposite to the bending piece in a vertical direction perpendicular to the front-to-back direction to be received in a recess in an underside of the housing for securing said first metallic shell to the housing;

wherein the shell further includes an oblique section on a rear side to form a receiving space in alignment with the mating cavity in the front-to-back direction;

further including a Z-shaped fixing column extending through the housing beside the oblique section in a transverse direction perpendicular to the front-to-back direction.

* * * * *